US009306289B1

(12) United States Patent
Bermeo et al.

(10) Patent No.: US 9,306,289 B1
(45) Date of Patent: Apr. 5, 2016

(54) TAPERED SLOT ANTENNA WITH REDUCED EDGE THICKNESS

(71) Applicant: The United States of America as represented by the Secretary of the Navy, Washington, DC (US)

(72) Inventors: Dennis Bermeo, San Diego, CA (US); Susan L. Morales, San Diego, CA (US); Hale B. Simonds, Santee, CA (US); David V. Arney, El Cajon, CA (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 465 days.

(21) Appl. No.: 13/926,725

(22) Filed: Jun. 25, 2013

(51) Int. Cl.
*H01Q 13/10* (2006.01)

(52) U.S. Cl.
CPC ..... *H01Q 13/10* (2013.01)

(58) Field of Classification Search
CPC ..... H01Q 21/064; H01Q 21/22
USPC ..... 343/700 MS, 767, 768, 770
See application file for complete search history.

(56) References Cited

U.S. PATENT DOCUMENTS 4,038,662 A * 7/1977 Turner ..... H01Q 9/065 343/752
5,325,105 A * 6/1994 Cermignani ..... H01Q 13/08 343/786
6,552,691 B2 * 4/2003 Mohuchy ..... H01Q 13/085 343/770
7,009,572 B1 3/2006 Homer et al.
7,148,855 B1 12/2006 Homer et al.
7,215,284 B2 * 5/2007 Collinson ..... H01Q 5/00 343/700 MS
7,265,718 B2 * 9/2007 Tsai ..... H01Q 1/24 343/700 MS
7,358,914 B1 4/2008 Homer
7,397,440 B1 7/2008 Homer et al.
7,518,565 B1 4/2009 Homer et al.
7,592,962 B1 9/2009 Homer et al.
7,612,729 B1 11/2009 Homer et al.
7,652,631 B2 * 1/2010 McGrath ..... H01Q 1/38 343/767
7,679,574 B1 3/2010 Homer
7,679,575 B1 3/2010 Homer et al.
7,692,596 B1 4/2010 Homer et al.
7,701,406 B1 4/2010 Homer et al.
7,773,043 B1 8/2010 Homer et al.
7,782,265 B1 8/2010 Homer et al.
7,843,398 B1 11/2010 Homer
9,077,080 B1 * 7/2015 Josypenko ..... H01Q 13/04

OTHER PUBLICATIONS

Yaghijian, Arthur D., and Stuart, Howard R., "Lower Bounds on the Q of Electrically Small Dipole Antennas", IEEE Transactions on Antennas and Propagation, vol. 58, No. 10, Oct. 2010.

* cited by examiner

*Primary Examiner* — Tho G Phan
(74) *Attorney, Agent, or Firm* — SPAWAR Systems Center Pacific; Kyle Eppele; Ryan J. Friedl

(57) ABSTRACT

An apparatus includes first and second antenna elements each having a tapered width end, with the tapered width ends being separated by a gap. A portion of the edge of the tapered width end of the each antenna element has a thickness less than a thickness of the remainder of the respective antenna element. Such portion may be the portion of the edge of the antenna elements closest to a feed point of the antenna elements, and may be angled to a point or a flat edge. The thickness of the tapered width ends increases along the width and/or the height of the respective antenna element as the antenna element extends from the feed point.

20 Claims, 3 Drawing Sheets

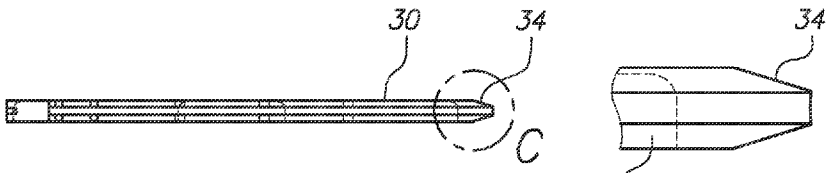
FIG. 3D
DETAIL C
FIG. 3E
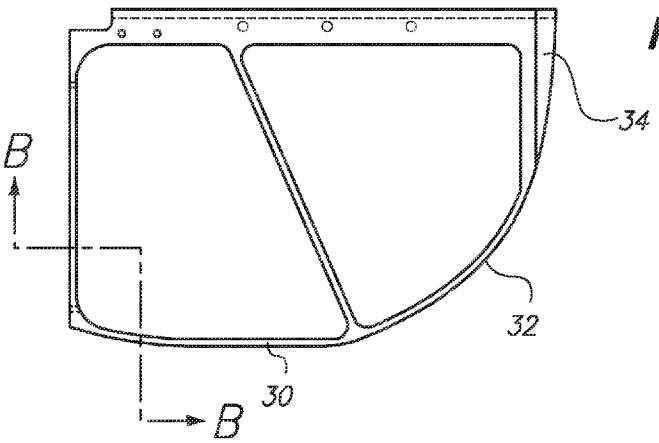
FIG. 3A
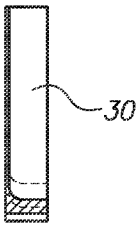
SECTION B–B
FIG. 3F
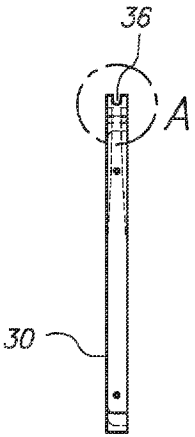
FIG. 3B
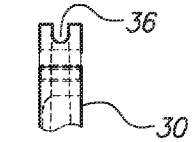
DETAIL A
FIG. 3C

TAPERED SLOT ANTENNA WITH REDUCED EDGE THICKNESS

FEDERALLY-SPONSORED RESEARCH AND DEVELOPMENT

The Tapered Slot Antenna with Reduced Edge Thickness is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil; reference Navy Case Number 101634.

BACKGROUND

A need exists for a tapered slot antenna that can operate at extended frequencies.

BRIEF DESCRIPTION OF THE DRAWINGS

FIG. 3A shows a side view of an embodiment of one antenna element in accordance with the Tapered Slot Antenna with Reduced Edge Thickness.

FIG. 3B shows a bottom view of the antenna element shown in FIG. 3A.

FIG. 3C shows a detailed view of a portion of the antenna element shown in FIG. 3B.

FIG. 3D shows a left side view of the antenna element shown in FIG. 3A.

FIG. 3E shows a detailed view of a portion of the antenna element shown in FIG. 3D.

FIG. 3F shows a front cross-section view of the portion of the antenna element shown in FIG. 3A along the line B-B.

DETAILED DESCRIPTION OF SOME EMBODIMENTS

Figure 1A:
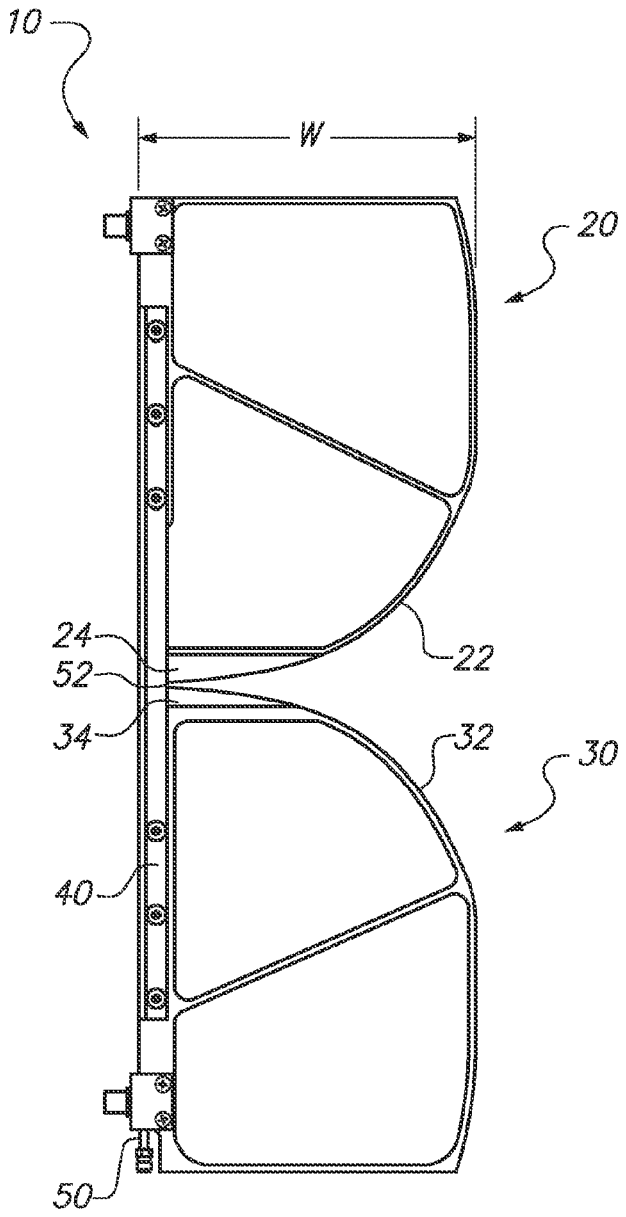
FIG. 1A shows a side view of an embodiment of an apparatus having two antenna elements in accordance with the Tapered Slot Antenna with Reduced Edge Thickness.
Figure 1B:
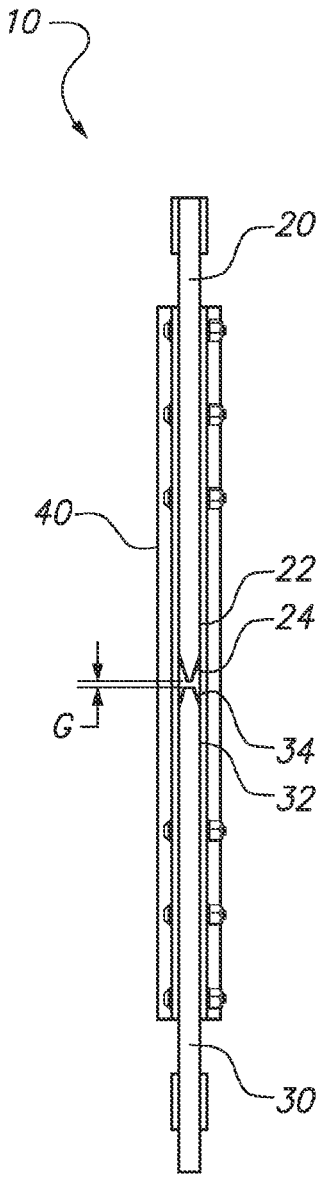
FIG. 1B shows a front view of the apparatus shown in FIG. 1A.

Referring to FIGS. 1A and 1B, FIG. 1A shows a side view and FIG. 1B shows a front view of an embodiment of an apparatus 10 in accordance with the Tapered Slot Antenna with Reduced Edge Thickness. Apparatus 10 includes a first antenna element 20 and a second antenna element 30. Antenna element 20 is shown in more detail in FIGS. 2A-2E, while antenna element 30 is shown in more detail in FIGS. 3A-3F. Antenna elements 20 and 30 are mounted to a support 40 such that they are separated by a gap G. As an example, antenna elements 20 and 30 may be fixed to support 40 using any non-conductive material. In some embodiments, the distance of gap G may be correlated to the thickness of antenna elements 20 and/or 30 to ensure properly matched impedance, as described in U.S. Pat. No. 7,701,406 to Horner et al., the entire content of which is fully incorporated by reference herein. In some embodiments, gap G may be adjusted to minimize the reflection from the antenna input.

Antenna elements 20 and 30 may comprise any conductive material that allows for reception and transmission of electromagnetic waves. As an example, antenna elements 20 and 30 may comprise of aluminum, steel, copper or any other conductive material. Support 40 may comprise a non-conductive material, such as fiberglass, Delrin®, or plastic. Conductive or non-conductive fasteners may be used to secure antenna elements 20 and 30 to support 40. Support 40 may be comprised of two L-shaped brackets or any other shapes so long as they physically support the structure and positioning of antenna elements 20 and 30.

A feed line 50, such as a coaxial cable, may be fed through support 40 and antenna element 20 to a feed point 52, with feed point 52 being proximate to gap G. Feed point 52 may be used to feed both antenna elements 20 and 30. A voltage applied across feed point 52 establishes a traveling electromagnetic wave that launches from antenna elements 20 and 30 and becomes a free propagating wave. The highest frequencies launch near feed point 52, while the lower frequencies launch at some point further away from feed point 52 along edges 24 and 34.

Feed point 52 helps provide high frequency performance and impedance match. The design of feed point 52 is driven in part by the size of feed line 50. For example, a small 0.144" coaxial cable may be used to feed antenna elements 20 and 30. In some embodiments, the cable fits into a cable slot 36 (see FIGS. 3B and 3C) in the rear of antenna element 30. Cable slot 36 terminates at feed point 52. Near feed point 52, this slot forms a transmission line, which may be, for example, a 50Ω transmission line.

Matching the impedance between two transmission lines is the minimum requirement for a good match. A poorly designed interface between two 50 Ω transmission lines will also cause a reflection. The interface between two 50 Ω transmission lines is analogous to a 90° elbow that connects two 50 Ω coaxial cables. In the coaxial cable, the charge/current density on the inner wire is several times higher than the shield. As the charge/current transitions from the cable to the slot, the relative charge/current density are about the same, which helps to reduce the reflection at the interface. For the ideal match, the capacitance and inductance per length would be the same for the cable and slot.

The transition region can be thought of a having extra capacitance and inductance. If the capacitance is too large this will short the high frequencies to ground (charge density very low on the edge). As an example, the inner cable wire of feed line 52 only needs to charge an edge portion 24 thickness of 0.063" on antenna element 20 (low capacitance). In addition, the capacitance can be decreased by using a larger slot gap. If the inductance is too large, no current will flows onto the antenna. The inductance near feed point 52 depends of the length (slot gap) of the inner wire of feed line 52. The capacitance and inductance at the transition region is a complex function of the geometry.

First antenna element 20 includes a tapered width end 22 and second antenna element 30 includes a tapered width end 32. As used herein, the term "tapered width end" refers to the increasing of the width W of the antenna element as a function of the increase in distance away from the feed point of the antenna element. In some embodiments, antenna elements 20 and 30 may have tapered curvatures that can be represented by the following equation:

$$Y(x)=a(e^{bx}-1) \quad \text{(Eq. 1)}$$

where a and b are parameters that may be selectively predetermined to maximize performance of the antenna. In one embodiment, parameters a and b are approximately equal to 0.2801 and 0.1028, respectively. In some embodiments, antenna elements 20 and 30 may have a specific height to width ratio to improve directivity and gain, as described in U.S. Pat. No. 7,773,043 to Horner et al., the entire content of which is fully incorporated by reference herein.

A portion of the edge of the tapered width end of the each antenna element has a thickness less than a thickness of the remainder of the respective antenna element. As an example, such portion may be the portion of the edge of the antenna elements closest to a feed point 52 of the antenna elements. As shown in FIG. 1B, antenna element 20 has a portion 24 that has a thickness less than a thickness of the remainder of antenna element 20, while antenna element 30 has a portion 34 that has a thickness less than a thickness of the remainder of antenna element 30. Portions 24 and 34 are the portions of the respective edges of antenna elements 20 and 30 that are closest to feed point 52.

FIG. 1B also shows how in some embodiments portion 24 may be angled to a point, while portion 34 may be angled to a flat surface. In such embodiments, portion 24 may resemble a "knife edge." In some embodiments, portion 24 may be angled to a flat surface while portion 34 is angled to a point, both portions 24 and 34 may be angled to a point, or both portions 24 and 34 may be angled to a flat surface. By having antenna elements with edges near the feed point having a reduced thickness, the tapered slot antenna provides for an increase in frequency response to about 18 GHz. Further frequency ranges may be achieved with smaller cable feeds and sharper knife edges.

As an example, at feed point 52 antenna element 30 has a reduced thickness of 0.155", which is only slightly larger than the diameter of 0.144" of feed line 52. The thickness of edge 34 of antenna element 30 may taper from 0.155" to 0.375" (see FIGS. 3D and 3E). As an example, the thickness taper angle may be 17° on both sides, however tapering the thickness at other angles is possible depending on the desired frequency response or impedance. The thickness taper near feed point 52 is helpful for the radiation of high frequencies. After the high frequencies have radiated, the thickness taper may be reduced as the gap G between the antenna elements 20 and 30 increases. The inner wire of feed line 52 connects through a hole 26 within antenna element 20 (see FIG. 2C). Hole 26 may be the same diameter as the inner wire of feed line 52. In some embodiments, the thickness of edge portion 24 is much smaller (0.063") than the thickness of edge portion 34 of antenna element 30. As an example, the thickness taper angle is 16.8° on both sides of edge portion 24.

Figure 2D:
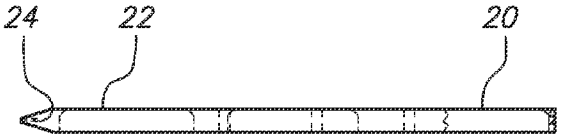
FIG. 2D shows a left side view of the antenna element shown in FIG. 2A.
Figure 2A:
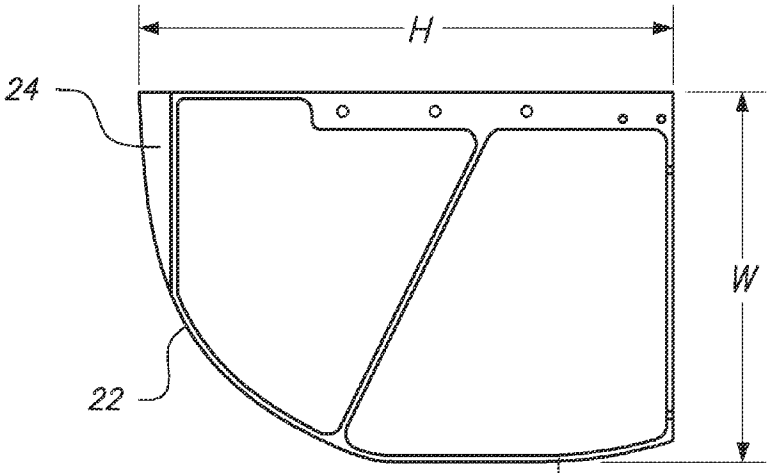
FIG. 2A shows a side view of an embodiment of one antenna element in accordance with the Tapered Slot Antenna with Reduced Edge Thickness.
Figure 2E:
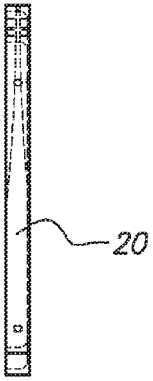
FIG. 2E shows a top view of the antenna element shown in FIG. 2A.
Figure 2B:
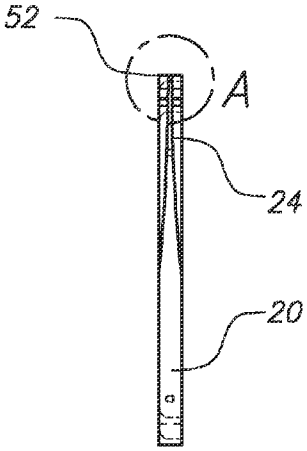
FIG. 2B shows a bottom view of the antenna element shown in FIG. 2A.
Figure 2C:
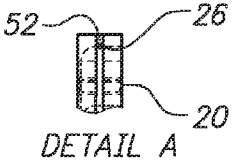
FIG. 2C shows a detailed view of a portion of the antenna element shown in FIG. 2B.

As shown in FIGS. 2A and 2B, in some embodiments, the thickness tapered edge portion 24 of antenna element 20 extends from feed point 52 of the antenna element 20 to at least half of the width, W, of the antenna element 20. In other embodiments, the thickness tapered edge portion 24 may extend less than half of the width of antenna element 20.

Also shown in FIG. 2B, tapered edge 24 has a thickness that increases along the width, W, of antenna element 20 as tapered edge extends from feed point 52, in addition to the increase in thickness along the height, H, of antenna element 20 as shown in FIG. 1B. Thus, as edge 24 extends from feed point 52, the thickness of edge 24 increases as edge 24 curves to form the tapered width. In some embodiments, the thickness of edge 24 increases at a constant rate. Further, in some embodiments, the thickness of edge 24 increases from feed point 52 for a certain distance until the thickness matches the thickness of the remainder of antenna element 20. The angles of the taper and the specific thicknesses may vary depending upon design considerations.

Likewise, as shown in FIG. 3B, antenna element 30 may have a tapered edge 34 that has an increase in thickness along the width of antenna element 30 from feed point 52 to the curvature of edge 34, similar to tapered edge 24. In some embodiments, tapered edge 34 has a tapered thickness less than half of the width of antenna element 30, while in other embodiments the tapered thickness is more than half of the width of antenna element 30. In some embodiments, the thickness of edge 34 increases at a constant rate. Further, in some embodiments, the thickness of edge 34 increases from feed point 52 for a certain distance until the thickness matches the thickness of the remainder of antenna element 30.

Many modifications and variations of the Tapered Slot Antenna with Reduced Edge Thickness are possible in light of the above description. Within the scope of the appended claims, the embodiments of the systems described herein may be practiced otherwise than as specifically described. The scope of the claims is not limited to the implementations and the embodiments disclosed herein, but extends to other implementations and embodiments as may be contemplated by those having ordinary skill in the art.

We claim:

1. An apparatus comprising:

a first slot antenna element having a tapered width end; and a second slot antenna element having a tapered width end, the tapered width end of the first slot antenna element separated from the tapered width end of the second slot antenna element by a gap, wherein at least a portion of the edge of the tapered width end of the first slot antenna element has a thickness less than a thickness of the remainder of the first slot antenna element.

2. The apparatus of claim 1, wherein the portion of the edge of the tapered width end of the first slot antenna element having a thickness less than the thickness of the remainder of the first slot antenna element is the portion of the edge closest to a feed point of the first slot antenna element.

3. The apparatus of claim 1, wherein the portion of the edge of the tapered width end of the first slot antenna element having a thickness less than the thickness of the remainder of the first slot antenna element is angled to a point.

4. The apparatus of claim 1, wherein the portion of the edge of the tapered width end of the first slot antenna element having a thickness less than the thickness of the remainder of the first slot antenna element is angled to a flat edge.

5. The apparatus of claim 1, wherein the portion of the edge of the tapered width end of the first slot antenna element having a thickness less than the thickness of the remainder of the first slot antenna element extends from a feed point of the first slot antenna element to at least half of the width of the first slot antenna element.

6. The apparatus of claim 1, wherein the tapered width end of the first slot antenna element has a thickness that increases along the width of the first slot antenna element as the first slot antenna element extends from a feed point of the first slot antenna element.

7. The apparatus of claim 1, wherein the tapered width end of the first slot antenna element has a thickness that increases along the height of the first slot antenna element as the first slot antenna element extends from a feed point of the first slot antenna element.

8. The apparatus of claim 1, wherein at least a portion of the edge of the tapered width end of the second slot antenna element has a thickness less than the thickness of the remainder of the second slot antenna element.

9. The apparatus of claim 8, wherein the portion of the edge of the tapered width end of the second slot antenna element having a thickness less than the thickness of the remainder of the second slot antenna element is the portion of the edge closest to a feed point of the second slot antenna element.

10. The apparatus of claim 8, wherein the portion of the edge of the tapered width end of the second slot antenna element having a thickness less than the thickness of the remainder of the second slot antenna element is angled to a point.

11. The apparatus of claim 8, wherein the portion of the edge of the tapered width end of the second slot antenna element having a thickness less than the thickness of the remainder of the second slot antenna element is angled to a flat edge.

12. The apparatus of claim 8, wherein the portion of the edge of the tapered width end of the second slot antenna element having a thickness less than the thickness of the remainder of the second slot antenna element extends from a feed point of the second slot antenna element to at least half of the width of the second slot antenna element.

13. The apparatus of claim 8, wherein the tapered width end of the second slot antenna element has a thickness that increases along the width of the second slot antenna element as the second slot antenna element extends from a feed point of the second slot antenna element.

14. The apparatus of claim 8, wherein the tapered width end of the second slot antenna element has a thickness that increases along the height of the second slot antenna element as the second slot antenna element extends from a feed point of the second slot antenna element.

15. An apparatus comprising:

a first slot antenna element having a tapered width end; and a second slot antenna element having a tapered width end, the tapered width end of the first slot antenna element separated from the tapered width end of the second slot antenna element by a gap, wherein at least a portion of the edge of the tapered width end of the first slot antenna element has a thickness less than a thickness of the remainder of the first slot antenna element, wherein at least a portion of the edge of the tapered width end of the second slot antenna element has a thickness less than the thickness of the remainder of the second slot antenna element, wherein the portion of the edge of the tapered width end of the first slot antenna element having a thickness less than the thickness of the remainder of the first slot antenna element is the portion of the edge closest to a feed point of the first slot antenna element, wherein the portion of the edge of the tapered width end of the second slot antenna element having a thickness less than the thickness of the remainder of the second slot antenna element is the portion of the edge closest to a feed point of the second slot antenna element.

16. The apparatus of claim 15, wherein the portion of the edge of the tapered width end of the first slot antenna element having a thickness less than the thickness of the remainder of the first slot antenna element is angled to a point.

17. The apparatus of claim 15, wherein the portion of the edge of the tapered width end of the first slot antenna element having a thickness less than the thickness of the remainder of the first slot antenna element extends from a feed point of the first slot antenna element to at least half of the width of the first slot antenna element, and wherein the portion of the edge of the tapered width end of the second slot antenna element having a thickness less than the thickness of the remainder of the second slot antenna element extends from a feed point of the second slot antenna element to at least half of the width of the second slot antenna element.

18. The apparatus of claim 15, wherein the tapered width end of the first slot antenna element has a thickness that increases along the width and the height of the first slot antenna element as the first slot antenna element extends from the feed point.

19. The apparatus of claim 15, wherein the tapered width end of the second slot antenna element has a thickness that increases along the height and the width of the second slot antenna element as the second slot antenna element extends from a feed point of the second slot antenna element.

20. An apparatus comprising:

a first slot antenna element having a tapered width end; and a second slot antenna element having a tapered width end, the tapered width end of the first slot antenna element separated from the tapered width end of the second slot antenna element by a gap, wherein at least a portion of the edge of the tapered width end of the first slot antenna element has a thickness that increases along the width and the height of the first slot antenna element as the first slot antenna element extends from a feed point of the first slot antenna element, wherein the tapered width end of the second slot antenna element has a thickness that increases along the height and the width of the second slot antenna element as the second slot antenna element extends from a feed point of the second slot antenna element.

* * * * *